US011112732B1

(12) United States Patent
Shimizu et al.

(10) Patent No.: US 11,112,732 B1
(45) Date of Patent: Sep. 7, 2021

(54) IMAGE FORMING DEVICE

(71) Applicant: KYOCERA Document Solutions Inc., Osaka (JP)

(72) Inventors: Tamotsu Shimizu, Osaka (JP); Yasuhiro Tauchi, Osaka (JP); Akira Matayoshi, Osaka (JP); Masashi Fujishima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/171,357

(22) Filed: Feb. 9, 2021

(30) Foreign Application Priority Data

Feb. 14, 2020 (JP) ..... JP2020-023313

(51) Int. Cl.
*G03G 15/09* (2006.01)
*G03G 15/16* (2006.01)
(Continued)

(52) U.S. Cl.
CPC ..... *G03G 15/0907* (2013.01); *G03G 15/0266* (2013.01); *G03G 15/0808* (2013.01); *G03G 15/1675* (2013.01)

(58) Field of Classification Search
CPC ..... G03G 15/0266; G03G 15/1675; G03G 15/065; G03G 15/5037; G03G 15/0808; G03G 15/0907
See application file for complete search history.

(56) References Cited

U.S. PATENT DOCUMENTS

2012/0237271 A1* 9/2012 Sengoku ..... G03G 15/161 399/296
2013/0308969 A1* 11/2013 Hasegawa ..... G03G 15/0266 399/50
(Continued)

FOREIGN PATENT DOCUMENTS

JP H5-107835 4/1993
JP H9-138581 5/1997
(Continued)

*Primary Examiner* — Walter L Lindsay, Jr.
*Assistant Examiner* — Jessica L Eley
(74) *Attorney, Agent, or Firm* — Lex IP Meister, PLLC

(57) ABSTRACT

A bias condition determination portion of an image forming device executes each of: a first approximation expression determination operation that respectively acquires the DC component of the development current with at least three peak-to-peak voltages included in a first measurement range and determines a first expression showing a relation between the peak-to-peak voltage and the DC component of the acquired development current, a second approximation expression determination operation that respectively acquires the DC component of the development current with at least three peak-to-peak voltages included in a second measurement range larger than the first measurement range and determines a second approximation expression showing a relation between the peak-to-peak voltage and the DC component of the acquired development current, and a reference voltage determination operation that determines, as a reference peak-to-peak voltage, the peak-to-peak voltage at an intersection where the first approximation expression and the second approximation expression intersect each other.

11 Claims, 10 Drawing Sheets

(51) Int. Cl.
*G03G 15/08* (2006.01)
*G03G 15/02* (2006.01)

(56) References Cited

U.S. PATENT DOCUMENTS

2015/0293470 A1* 10/2015 Shimizu ..... G03G 15/0808
399/265
2016/0320746 A1* 11/2016 Makino ..... G03G 21/20

FOREIGN PATENT DOCUMENTS

JP 2006-64955 3/2006
JP 2015-203731 11/2015

* cited by examiner

IMAGE FORMING DEVICE

INCORPORATION BY REFERENCE

This application is based upon, and claims the benefit of priority from, corresponding Japanese Patent Application No. 2020-023313 filed in the Japan Patent Office on Feb. 14, 2020, the entire contents of which are incorporated herein by reference.

BACKGROUND

Field of the Invention

The present disclosure relates to an image forming device including a development device to which a two-component developing method is applied.

Description of Related Art

Typically, as an image forming device for forming an image on a sheet, one including a photoconductor drum (image carrier), a development device, and a transfer member is known. When an electrostatic latent image formed on the photoconductor drum is manifested with a toner by the development device, a toner image is formed on the photoconductor drum. The toner image is transferred to the sheet by the transfer member. As the development device applied to such an image forming device, a two-component developing technology using a development agent containing a toner and a carrier is known.

In the two-component developing technology, the development device has a development roller, and a preferable toner image is formed by applying, to the development roller, a development bias in which an AC bias is superimposed on a DC bias. In particular, when a Vpp (peak-to-peak voltage) among the AC biases is set high, the image concentration increases, and the texture of the half-tone image tends to improve and the half pitch nonuniformity, which tends to occur in the rotation cycle of the development roller, tends to improve. On the other hand, when the Vpp is set too high, a leak may occur to a development nip portion where the photoconductor drum and the development roller face each other. For this reason, a technology for appropriately setting the Vpp of the AC bias among the development biases has been proposed.

SUMMARY

An image forming device according to a first aspect of the present disclosure is capable of executing an image forming operation that forms an image on a sheet, and is provided with an image carrier, a charge device, an exposure device, a development device, a transfer portion, a development bias application portion, a current detection portion, and a bias condition determination portion. The image carrier is rotated, and has a surface that allows an electrostatic latent image to be formed and carries a toner image which is the electrostatic latent image manifested by a toner. The charge device charges the image carrier to a specific charge potential. The exposure device is arranged on a more downstream side than the charge device in a rotational direction of the image carrier, and exposes, according to specific image information, the surface of the image carrier charged to the charge potential to thereby form the electrostatic latent image. The development device is arranged to face the image carrier in a specific development nip portion on a more downstream side than the exposure device in the rotational direction, and includes a development roller that has a peripheral surface, which is rotated and carries a development agent composed of the toner and a carrier, and that forms the toner image by supplying the toner to the image carrier. The transfer portion transfers, to the sheet, the toner image supported on the image carrier. The development bias application portion is capable of applying, to the development roller, a development bias in which an AC voltage is superimposed on a DC voltage. The current detection portion is capable of detecting a DC component of a development current that flows across the development roller and the development bias application portion. The bias condition determination portion, based on the DC component of the development current detected by the current detection portion when a specific measurement latent image is developed with the toner by applying the development bias to the development roller corresponding to the specific measurement latent image formed on the image carrier, executes a bias condition determination mode that determines a reference peak-to-peak voltage which becomes a reference for a peak-to-peak voltage of the AC voltage of the development bias applied to the development roller in the image forming operation. In the bias condition determination mode, the bias condition determination portion executes each of a first approximation expression determination operation, a second approximation expression determination operation, and a reference voltage determination operation. In the first approximation expression determination operation, the bias condition determination portion respectively acquires the DC component of the development current under a condition that the peak-to-peak voltages of the AC component of the development bias are respectively set to at least three first measurement peak-to-peak voltages included in a specific first measurement range, and determines a first approximation expression which is a primary approximation expression showing a relation between the first measurement peak-to-peak voltage in the first measurement range and the DC component of the acquired development current. In the second approximation expression determination operation, the bias condition determination portion respectively acquires the DC component of the development current under a condition that the peak-to-peak voltages of the AC component of the development bias are respectively set to at least three second measurement peak-to-peak voltages included in a second measurement range set to have a minimum value larger than a maximum value of the first measurement range, and determines a second approximation expression which is a primary approximation expression showing a relation between the second measurement peak-to-peak voltage in the second measurement range and the DC component of the acquired development current. In the reference voltage determination operation, the bias condition determination portion determines, as the reference peak-to-peak voltage, the peak-to-peak voltage at an intersection where the first approximation expression determined by the first approximation expression determination operation and the second approximation expression determined by the second approximation expression determination operation intersect each other. Further, for an actual peak-to-peak voltage at the time of an image forming operation, with respect to the reference peak-to-peak voltage, a value of the reference peak-to-peak voltage as it is, a value acquired by multiplying the reference peak-to-peak voltage by a certain ratio, a value acquired by adding a constant value to the reference peak-to-peak voltage, or a value acquired by multiplying the certain ratio and adding the certain value is used.

DETAILED DESCRIPTION

Hereinafter, an image forming device 10 according to an embodiment of the present disclosure will be described in detail based on the drawings. In the present embodiment, a tandem type color printer is illustrated as an example of the image forming device. The image forming device may be, for example, a copying machine, a fax machine, and a combination of the above. Further, the image forming device may be an image forming device for forming a simple (monochrome) image. The image forming device 10 is capable of executing an image forming operation for forming an image on a sheet P.

Figure 1:
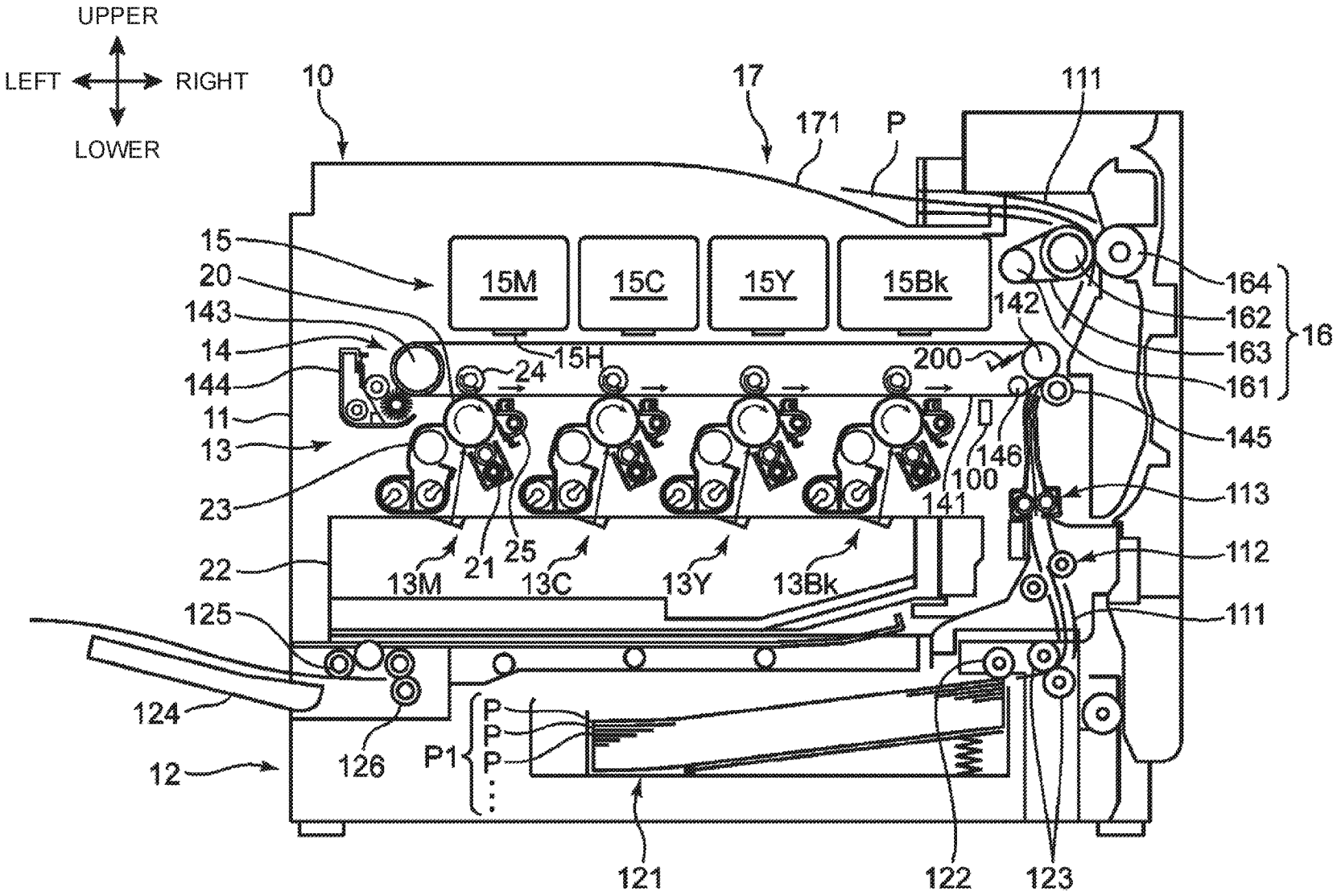
FIG. 1 is a cross-sectional view showing the internal structure of an image forming device, according to one embodiment of the present disclosure.

FIG. 1 is a cross-sectional view showing the internal structure of the image forming device 10. The image forming device 10 includes a device main body 11 having a box-shaped housing structure. Installed in the device main body 11 include a paper feed portion 12 that feeds a sheet P, an image forming portion 13 that forms a toner image to be transferred to the sheet P fed from the paper feed portion 12, an intermediate transfer portion 14 (transfer portion) to which the toner image is primarily transferred, a toner replenishment portion 15 that replenishes the toner to the image forming portion 13, and a fixing portion 16 that executes a processing of fixing, to the sheet P, any unfixed toner image formed on the sheet P. Further, the upper part of the device main body 11 is provided with a paper ejection portion 17 to which the sheet P that has been fixed by the fixing portion 16 is ejected.

An operation panel (not shown) for inputting and operating the output conditions or the like for the sheet P is provided at an appropriate position on the upper surface of the main body 11. This operation panel is provided with a power key, a touch panel for inputting output conditions, and various operation keys.

In the device main body 11, further, a sheet transfer path 111 extending in the vertical direction is formed on the right side of the image forming portion 13. The sheet transfer path 111 is provided with a transfer roller pair 112 that transfers the sheet P to a proper place. In addition, a resist roller pair 113 that executes skew correction of the sheet P and feeds the sheet P to a below-described secondary transfer nip portion at a specific timing is provided on the upstream side of the nip portion in the sheet transfer path 111. The sheet transfer path 111 is a transfer path for transferring the sheet P from the paper feed portion 12 to the paper ejection portion 17 via the image forming portion 13 and the fixing portion 16.

The paper feed portion 12 includes a paper feed tray 121, a pick-up roller 122, and a paper feed roller pair 123. The paper feed tray 121 is detachably attached to the lower position of the device main body 11 and stores a sheet bundle P1 in which a plurality of sheets P are stacked. The pick-up roller 122 feeds out the sheet P one by one on the uppermost surface of the sheet bundle P1 stored in the paper feed tray 121. To the sheet transfer path 111, the paper feed roller pair 123 sends the sheet P fed out by the pick-up roller 122.

The paper feed portion 12 includes a manual paper feed portion that is attached to the left side surface of the device main body 11 as shown in FIG. 1. The manual paper feed portion is provided with a manual feed tray 124, a pick-up roller 125, and a paper feed roller pair 126. The manual feed tray 124 is a tray on which the manually fed sheet P is placed, and when the sheet P is to be manually fed, the manual feed tray 124 is released from the side surface of the device main body 11 as shown in FIG. 1. The pick-up roller 125 feeds out the sheet P placed on the manual feed tray 124. To the sheet transfer path 111, the paper feed roller pair 126 sends out the sheet P fed out by the pick-up roller 125.

The image forming portion 13 forms a toner image to be transferred to the sheet P, and includes a plurality of image forming units that form toner images of different colors. As this image forming unit, in the present embodiment, a magenta unit 13M using a magenta (M) color development agent, a cyan unit 13C using a cyan (C) color development agent, a yellow unit 13Y using a yellow (Y) color development agent, and a black unit 13Bk using a black (Bk) color development agent are sequentially arranged from the upstream side to the downstream side (from the left side to the right side shown in FIG. 1) in the rotational direction of an intermediate transfer belt 141 described below. Each of the units 13M, 13C, 13Y, 13Bk is provided with a photoconductor drum 20 (image carrier), a charge device 21, a development device 23, a primary transfer roller 24, and a cleaning device 25 which are respectively arranged around the photoconductor drum 20. In addition, an exposure device 22 common to each of the units 13M, 13C, 13Y, and 13Bk is arranged below the image forming unit.

The photoconductor drum 20 is rotationally driven around an axis thereof, and has a cylindrical surface that allows an electrostatic latent image to be formed and carries a toner image which is the electrostatic latent image manifested by a toner. As the photoconductor drum 20, as an example, a known amorphous silicon (α-Si) photoconductor drum or an organic (OPC) photoconductor drum is used. The charge device 21 uniformly charges the surface of the photoconductor drum 20 to a specific charge potential. The charge device 21 includes a charge roller, and a charge cleaning brush for removing any toner adhering to the charge roller. The exposure device 22 is arranged on the more downstream side than the charge device 21 in the rotational direction of the photoconductor drum 20, and has various optical system devices such as a light source, a polygon mirror, a reflection mirror, and a deflection mirror. The exposure device 22 irradiates the surface of the photoconductor drum 20, which is uniformly charged to the charge potential, with a light modulated based on the image data (specific image information) and exposes the surface, to thereby form an electrostatic latent image.

The development device 23 is arranged to face the photoconductor drum 20 in a specific development nip portion NP (FIG. 3A) on the more downstream side than the exposure device 22 in the rotational direction of the photoconductor drum 20. The development device 23 includes a development roller 231 that has a peripheral surface which is rotated and carries a development agent composed of a toner and a carrier, and that forms the toner image by supplying the toner to the photoconductor drum 20.

The primary transfer roller 24 forms a nip portion with the photoconductor drum 20 by sandwiching the intermediate transfer belt 141 provided in the intermediate transfer portion 14. Further, onto the intermediate transfer belt 141, the primary transfer roller 24 primarily transfers the toner image on the photoconductor drum 20. The cleaning device 25 cleans the peripheral surface of the photoconductor drum 20 after the toner image is transferred.

The intermediate transfer portion 14 is arranged in a space provided between the image forming portion 13 and the toner replenishment portion 15, and includes the intermediate transfer belt 141, a drive roller 142 rotatably supported by a unit frame (not shown), a follower roller 143, a backup roller 146, and a concentration sensor 100. The intermediate transfer belt 141 is an endless belt-shaped rotating body, and is bridged over the drive roller 142, the follower roller 143, and the backup roller 146 so that the peripheral surface side of the intermediate transfer belt 141 abuts on the peripheral surface of each photoconductor drum 20. The intermediate transfer belt 141 is orbitally driven by the rotation of the drive roller 142. In the vicinity of the follower roller 143, there is arranged a belt cleaning device 144 that removes the toner remaining on the peripheral surface of the intermediate transfer belt 141. The concentration sensor 100 (concentration detection unit) is arranged on the downstream side of the units 13M, 13C, 13Y, and 13Bk so as to face the intermediate transfer belt 141, and detects, by reflected light, the concentration of the toner image formed on the intermediate transfer belt 141 (reflection type). Further, in another embodiment, the concentration sensor 100 may be one that detects the concentration of the toner image on the photoconductor drum 20, or may be one that detects the concentration of the toner image fixed on the sheet P.

Facing the drive roller 142, a secondary transfer roller 145 is arranged on the outside of the intermediate transfer belt 141. The secondary transfer roller 145 is pressed to the peripheral surface of the intermediate transfer belt 141 to thereby form a transfer nip portion with the drive roller 142. At the transfer nip portion, the toner image primarily transferred onto the intermediate transfer belt 141 is secondarily transferred to the sheet P supplied from the paper feed portion 12. That is, the intermediate transfer portion 14 and the secondary transfer roller 145 function as a transfer portion that transfers, to the sheet P, the toner image supported on the photoconductor drum 20. In addition, in the drive roller 142, there is arranged a roll cleaner 200 for cleaning the peripheral surface of the drive roller 142.

The toner replenishment portion 15 stores the toner used for the image formation. In the present embodiment, the toner replenishment portion 15 is provided with a magenta toner container 15M, a cyan toner container 15C, a yellow toner container 15Y, and a black toner container 15Bk. These toner containers 15M, 15C, 15Y, and 15Bk respectively store the toners for replenishment of the colors M/C/Y/Bk. From a toner outlet port 15H formed on the bottom of the container, the toner of each color is replenished to the development devices 23 of the image forming units 13M, 13C, 13Y, 13Bk corresponding to respective colors of M/C/Y/Bk.

The fixing portion 16 includes a heating roller 161 having an internal heat source, a fixing roller 162 arranged to face the heating roller 161, a fixing belt 163 stretched across the fixing roller 162 and the heating roller 161, and a pressurizing roller 164 that is arranged to face the fixing roller 162 via the fixing belt 163 and forms a fixing nip portion. The sheet P supplied to the fixing portion 16 is heated and pressurized by passing through the fixing nip portion. With this, the toner image transferred to the sheet P at the transfer tip portion is fixed to the sheet P.

The paper ejection portion 17 is formed by denting the top of the device main body 11, and a paper ejection tray 171 for receiving the ejected sheet P is formed at the bottom of the dent portion. The sheet P that has been subjected to the fixing processing is discharged toward the paper ejection tray 171 via the sheet transfer path 111 extending from the upper part of the fixing portion 16.

<Development Device>

Figure 2:
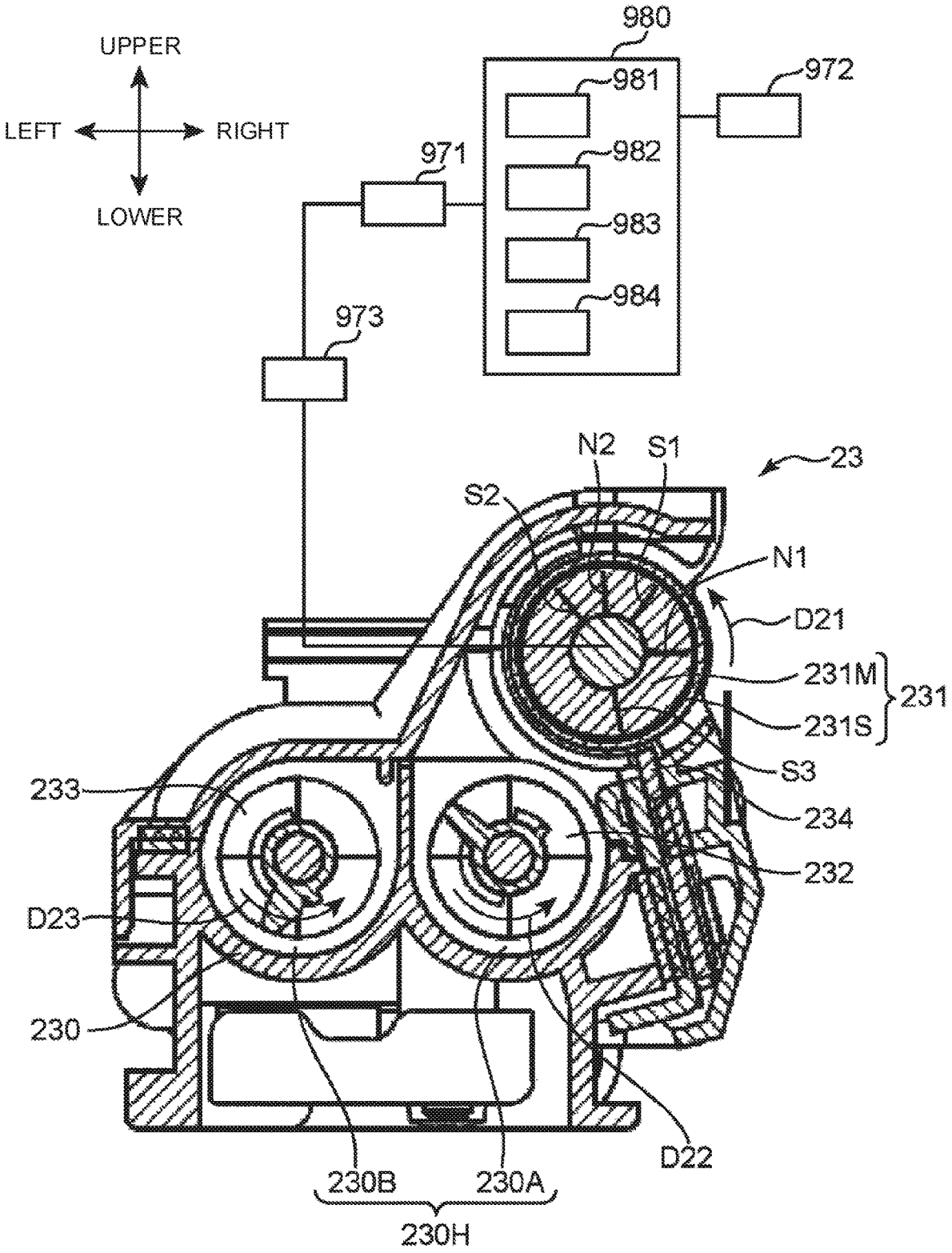
FIG. 2 is a cross-sectional view of the development device and a block diagram showing the electrical configuration of a control unit, according to the one embodiment of the present disclosure.

FIG. 2 is a cross-sectional view of the development device 23, and a block diagram showing the electrical configuration of a control portion 980, according to the present embodiment. The development device 23 includes a development housing 230, the development roller 231, a first screw feeder 232, a second screw feeder 233, and a regulation blade 234. A two-component developing method is applied to the development device 23.

The development housing 230 is provided with a development agent accommodating portion 230H. The development agent accommodating portion 230H contains a two-component development agent including toner and carrier. Further, the development agent accommodating portion 230H includes a first transfer portion 230A in which the development agent is transferred in a first transfer direction (direction orthogonal to the paper surface in FIG. 2, direction from rear to front) from one end side to the other end side in the axial direction of the development roller 231, and a second transfer portion 230B which is communicated with the first transfer portion 230A at both end portions in the axial direction and in which the development agent is transferred in a second transfer direction opposite to the first transfer direction. The first screw feeder 232 and the second screw feeder 233 are rotated in the directions of arrows D22 and D23 in FIG. 2, and transfer the development agent in the first transfer direction and the second transfer direction, respectively. In particular, the first screw feeder 232 supplies the development agent to the development roller 231 while transferring the development agent in the first transfer direction.

In the development nip portion NP (FIG. 3A), the development roller 231 is arranged to face the photoconductor drum 20. The development roller 231 includes a rotated sleeve 231S and a magnet 231M that is fixedly arranged inside the sleeve 231S. The magnet 231M has S1, N1, S2, N2 and S3 poles. The N1 pole functions as a main pole, the S1 pole and N2 pole each function as a transfer pole, and the S2 pole functions as a peeling pole. In addition, the S3 pole functions as a pumping pole and a regulating pole. As an example, magnetic flux densities of S1 pole, N1 pole, S2 pole, N2 pole, and S3 pole are set to 54 mT, 96 mT, 35 mT, 44 mT, and 45 mT. The sleeve 231S of the development roller 231 is rotated in the direction of an arrow D21 in FIG. 2. The development roller 231 is rotated, receives the development agent in the development housing 230, supports the development agent layer, and supplies the toner to the photoconductor drum 20. In the present embodiment, in a position where the development roller 231 faces the photoconductor drum 20, the development roller 231 rotates in the same direction (with direction). Further, in the axial direction (width direction) of the development roller 231, the range in which a magnetic brush of the two-component development agent is formed is, as an example, 304 mm.

The regulation blade 234 (layer thickness regulating member) is arranged on the development roller 231 at a specific interval, and regulates the layer thickness of the development agent supplied from the first screw feeder 232 onto the peripheral surface of the development roller 231.

The image forming device 10 provided with the development device 23 further includes a development bias application portion 971, a drive portion 972, an ammeter 973 (current detection unit), and a control portion 980. The control portion 980 is composed of a CPU (Central Processing Unit), a ROM (Read Only Memory) for storing a control program, and a RAM (Random Access Memory) used as a work area of the CPU, and the like.

The development bias application portion 971 is composed of a DC power supply and an AC power supply, and based on a control signal from a bias control portion 982 described below, applies, to the development roller 231 of the development device 23, a development bias in which the AC voltage is superimposed on the DC voltage.

The drive portion 972 includes a motor and a gear mechanism that transmits the torque of the motor, and in response to a control signal from a drive control portion 981 described below, at the time of the development operation, in addition to the photoconductor drum 20, rotationally drives the development roller 231, the first screw feeder 232, and the second screw feeder 233 in the development device 23.

The ammeter 973 detects the direct current (direct current component of the development current) flowing across the development roller 231 and the development bias application portion 971.

With the CPU executing the control program stored in the ROM, the control portion 980 functions as to be provided with the drive control portion 981, a bias control portion 982, a storage portion 983, and a calibration execution portion 984 (bias condition determination portion).

The drive control portion 981 controls the drive portion 972 to thereby rotatably drive the development roller 231, the first screw feeder 232, and the second screw feeder 233. In addition, the drive control portion 981 controls a drive mechanism (not shown) to thereby rotatably drive the photoconductor drum 20.

The bias control portion 982 controls the development bias application portion 971 at the time of the development operation (at the time of the image forming operation) in which the toner is supplied from the development roller 231 to the photoconductor drum 20, and provides potential differences of the DC voltage and the AC voltage between the photoconductor drum 20 and the development roller 231. Due to the potential differences, the toner is moved from the development roller 231 to the photoconductor drum 20.

The storage portion 983 stores various information referred to by the drive control portion 981, the bias control portion 982, and the calibration execution portion 984. As an example, the rotation speed of the development roller 231, the value of the development bias adjusted according to the environment, and the like are stored. In addition, the storage portion 983 stores the print rate and the number of lines set according to each toner image at the time of forming a plurality of measurement toner images. The data stored in the storage portion 983 may be in the form of a graph, a table, or the like.

The calibration execution portion 984 executes an AC calibration (bias condition determination mode) described below. In the AC calibration, the calibration execution portion 984 forms a plurality of measurement toner images on the photoconductor drum 20 while controlling the photoconductor drum 20, the charge device 21, the exposure device 22, and the development device 23. Then, based on the DC current detected by the ammeter 973 when a specific measurement latent image is developed with a toner by applying the development bias to the development roller 231 corresponding to the specific measurement latent image formed on the photoconductor drum 20, the calibration execution portion 984 determines a reference peak-to-peak voltage which becomes a reference of a peak-to-peak voltage of the AC voltage of the development bias applied to the development roller 231 in the image forming operation.

<Development Operation>

Figure 3A:
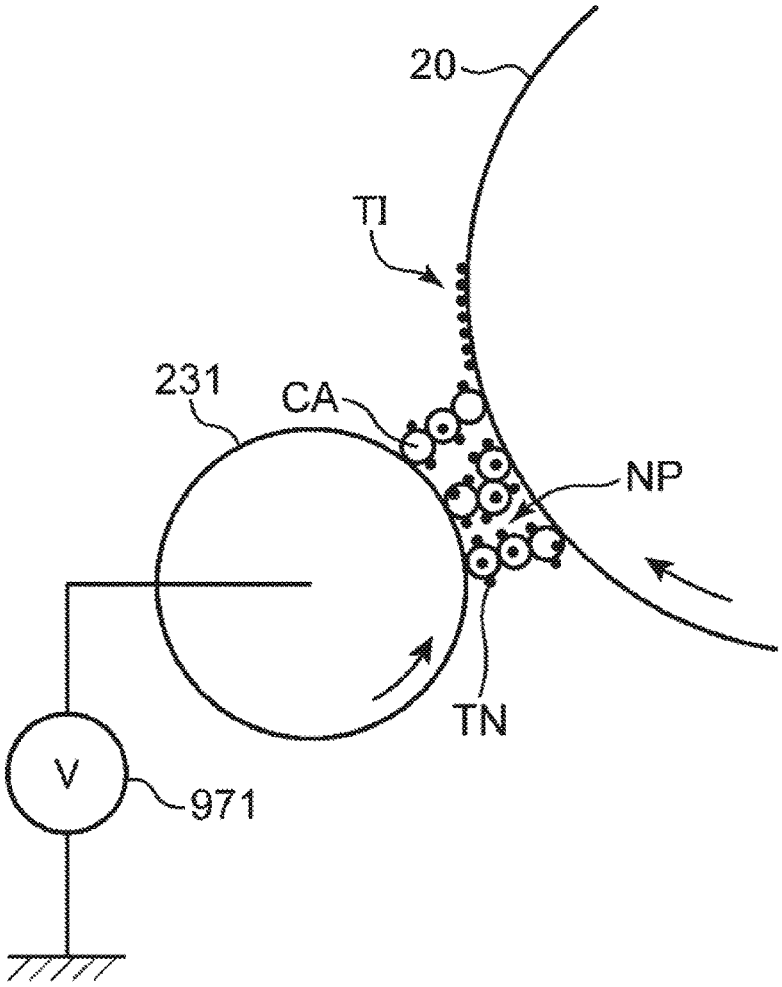
FIG. 3A is a schematic diagram showing a development operation of the image forming device, according to the one embodiment of the present disclosure.
Figure 3B:
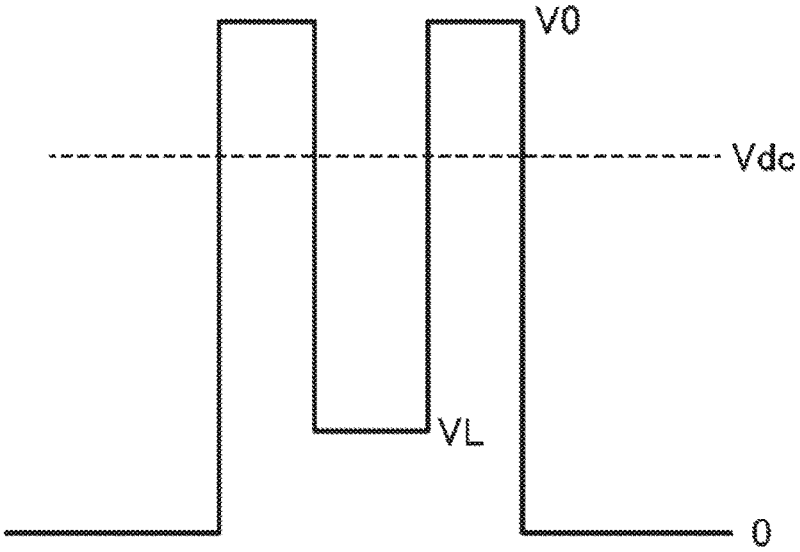
FIG. 3B is a schematic diagram showing a magnitude relation between the potentials of an image carrier and a development roller, according to the one embodiment of the present disclosure.

FIG. 3A is a schematic diagram of the development operation of the image forming device 10 according to the present embodiment, and FIG. 3B is a schematic diagram showing the magnitude relation between the potentials of the photoconductor drum 20 and the development roller 231. With reference to FIG. 3A, the development nip portion NP is formed between the development roller 231 and the photoconductor drum 20. A toner TN and a carrier CA which are supported on the development roller 231 form a magnetic brush. In the development nip portion NP, the toner TN is supplied from the magnetic brush to the photoconductor drum 20 side, and a toner image TI is formed. With reference to FIG. 3B, the surface potential of the photoconductor drum 20 is charged to a background portion potential VO (V) by the charge device 21. After that, when the exposure light is irradiated by the exposure device 22, the surface potential of the photoconductor drum 20 is changed from the background portion potential VO to an image portion potential VL (V) at maximum according to the image to be printed. On the other hand, a DC voltage Vdc of the development bias is applied to the development roller 231, and an AC voltage (not shown) is superimposed on the DC voltage Vdc.

In the case of such an inversion development method, the potential difference between the surface potential VO and the direct current component Vdc (DC bias) of the development bias is the potential difference that suppresses the toner fog on the background portion of the photoconductor drum 20. On the other hand, the potential difference, after the exposure, between the surface potential VL and the DC component Vdc of the development bias becomes a development potential difference that moves the toner of the plus polarity to the image portion of the photoconductor drum 20. Further, the AC component (AC bias) of the development bias applied to the development roller 231 promotes the transfer of the toner from the development roller 231 to the photoconductor drum 20.

<Relation Between Development Bias and Image Concentration>

Here, there is provided a property that, when the charge amount of the toner in the development device 23 changes, or when a developing gap changes due to a runout or the like of the development roller 231, in any of the above DC bias and AC bias, a transfer force F (=toner charge amount Q multiplied by electric field magnitude E) changes, and the image concentration fluctuates. However, strictly speaking, the DC bias and the AC bias also have characteristics different from each other. In the case of AC bias, when the Vpp (peak-to-peak voltage) thereof is increased, the image concentration will increase, but eventually the increase in image concentration will almost disappear, and when the Vpp is further increased, the image concentration will decrease on the contrary. On the other hand, when the development potential difference (Vdc−VL) in the DC bias is increased, the image concentration continues to increase, and the increase amount of the image concentration eventually decreases, but the decrease in image concentration as in the AC bias was not confirmed. It is presumed that this is because the AC electric field forms a bidirectional electric field (reciprocating electric field) between the photoconductor drum 20 and the development roller 231 in the development nip portion, while the DC electric field forms a unidirectional electric field.

More specifically, the reciprocating electric field of the AC bias includes two electric fields of two directions opposite to each other, that is, a development electric field that supplies the toner from the development roller 231 to the photoconductor drum 20, and a recovery electric field that recovers the toner from the photoconductor drum 20 to the development roller 231. Then, when the Vpp is increased, both electric fields increase, but eventually the amount of the toner supplied by the development electric field becomes maximum. After that, when the Vpp is further increased, the amount of toner recovered is increased due to the increase of the recovery electric field, but the amount of toner supplied by the development electric field is already the maximum. As a result, the final development amount of the toner decreases as the Vpp increases, depending on the magnitude relation of supply relative to recovery of the toner between the photoconductor drum 20 and the development roller 231.

<Relation Between Vpp and Development Current>

In this way, while the relation of the DC bias and AC bias relative to the development amount of the toner can be grasped, it was not well known how the development current flowing across the development roller 231 and the development bias application portion 971 behaved when the Vpp of the AC bias is increased.

It is presumed that the cause of this is that the development current generated in the development nip portion NP is composed of "toner transfer current that flows due to the transfer of the toner" and "magnetic brush current that flows through the magnetic brush of the development agent in the image portion (image portion magnetic brush current)", and "magnetic brush current that flows through the magnetic brush of the development agent in the non-image portion (non-image portion magnetic brush current)". This is because the toner transfer current changes according to the transfer amount of the toner, therefore, when the Vpp is increased, the toner transfer current will increase and then decrease, but the image portion magnetic brush current, since being the current flowing through the magnetic brush in the development nip portion NP, tends to increase as the Vpp increases. Further, in the non-image forming area existing at both end portions in the longitudinal direction of the image forming area, the non-image portion magnetic brush current tends to increase the current in the opposite direction as the Vpp increases. Therefore, it was not sufficiently known how the development current, which is complicatedly affected by the behavior of the total of the toner transfer current, the image portion magnetic brush current, and the non-image portion magnetic brush current, behaves as the Vpp increases.

Then, the present inventor has diligently conducted an experiment to confirm the behavior of the development current which behavior is seen when the Vpp of the AC bias of the development bias is increased, and thereby has newly discovered that there are multiple patterns in the tendency thereof. That is, it has become evident that, when the Vpp of the AC bias is increased, the development current (direct current) increases, and there is a first pattern in which the development current eventually reaches the change point where the gradient thereof changes and the development current gradually increases thereafter, and there is a second pattern in which the development current oppositely decreases from the above change point.

Based on such patterns of the development current, the present inventor newly focused on setting the Vpp of the AC bias to an area where the change in image concentration is small. As a result, it has become possible to reduce the change in image concentration even when the toner charge amount and the development gap may change. Details of the AC calibration for setting such Vpp are to be described below.

<AC Calibration>

Figure 4:
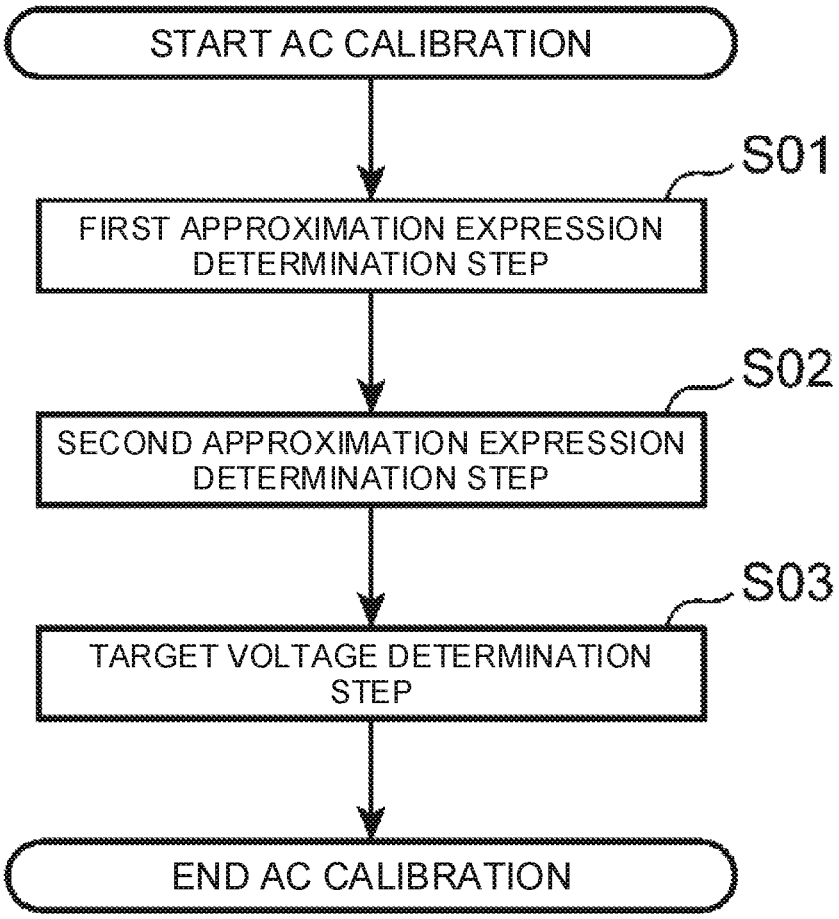
FIG. 4 is a flowchart of AC calibration executed in the image forming device, according to the one embodiment of the present disclosure.
Figure 5:
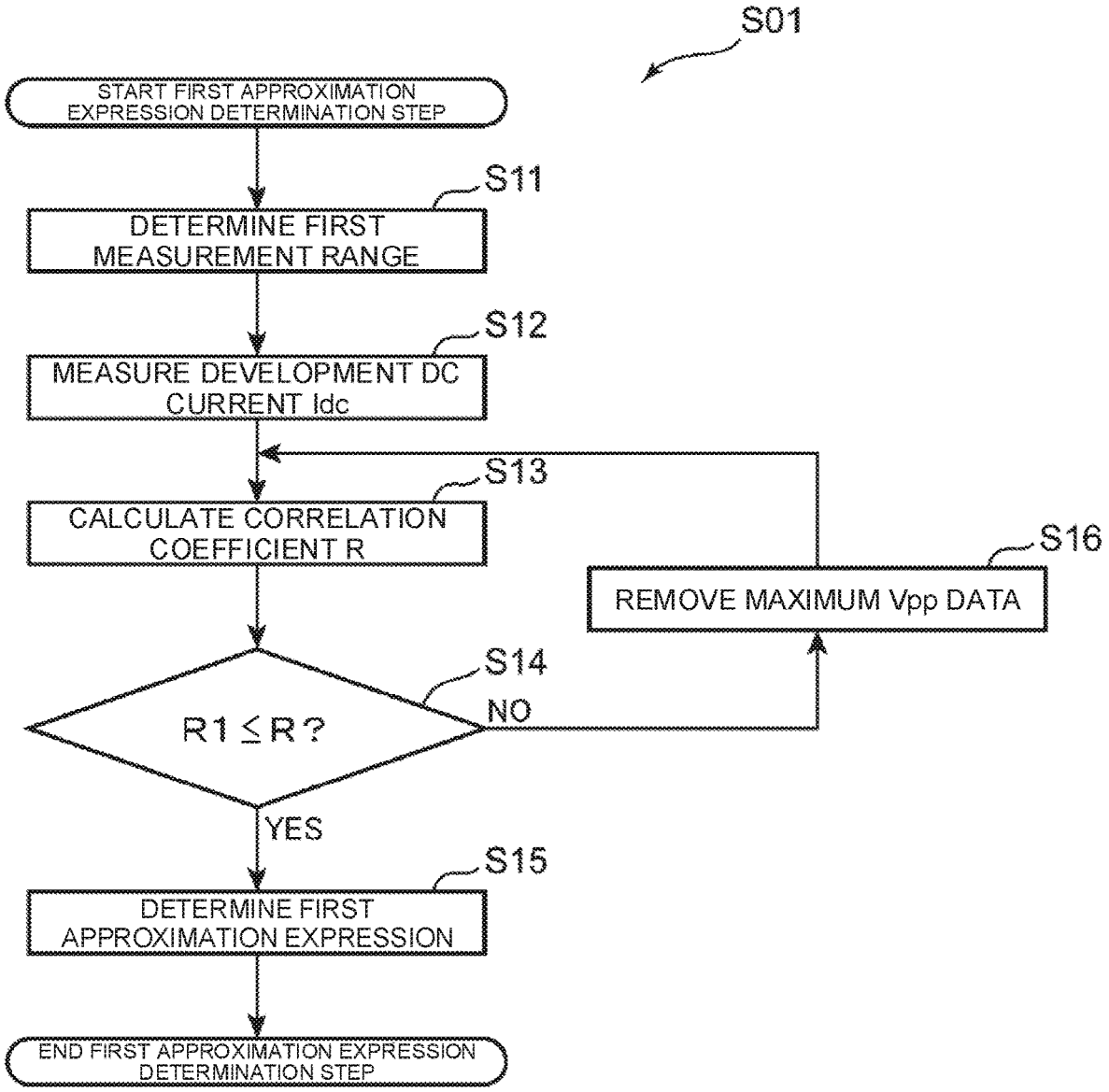
FIG. 5 is a flowchart of a first approximation expression determination step of the AC calibration executed in the image forming device, according to the one embodiment of the present disclosure.
Figure 6:
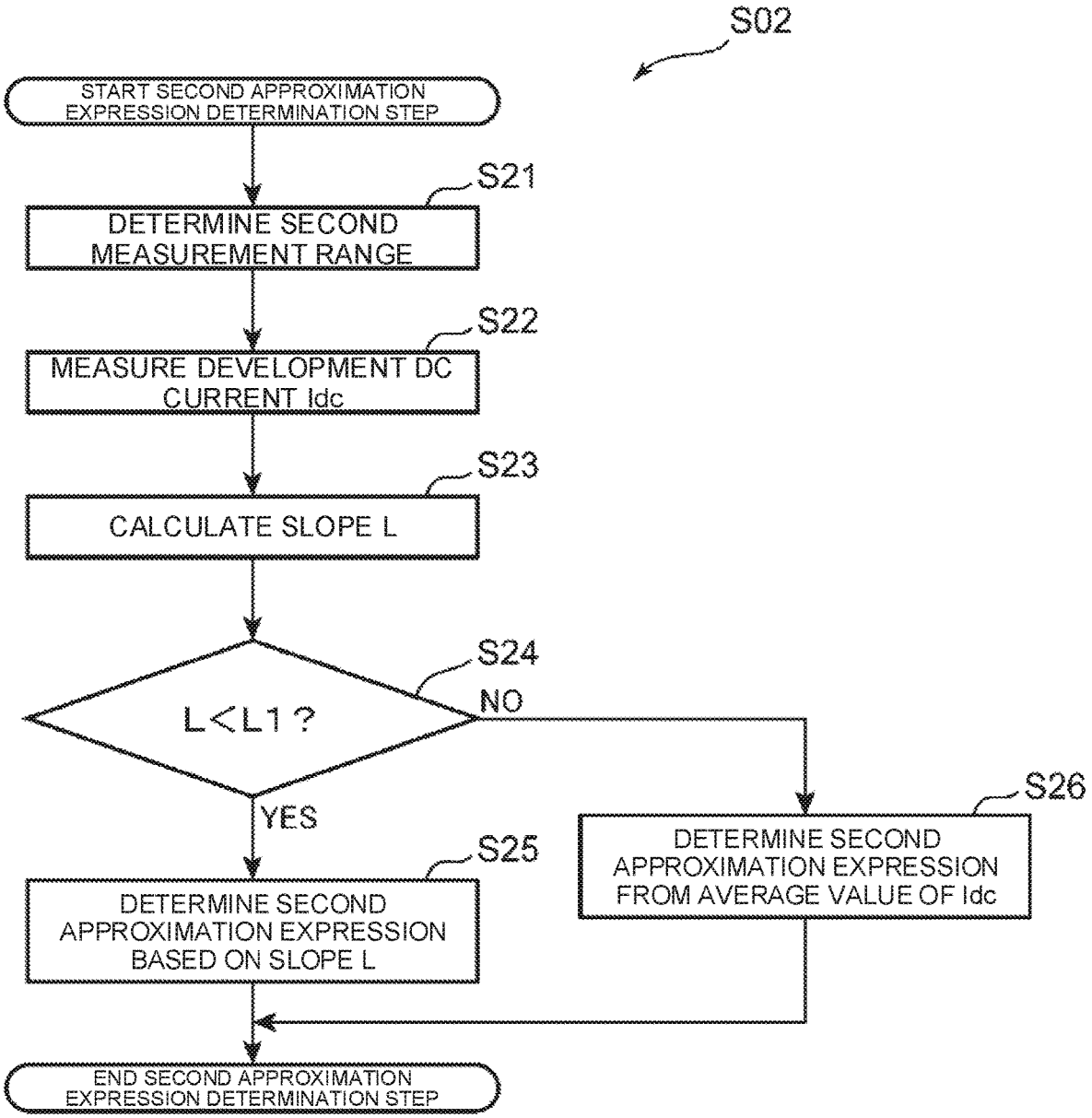
FIG. 6 is a flowchart of a second approximation expression determination step of the AC calibration executed in the image forming device, according to the one embodiment of the present disclosure.

FIG. 4 is a flowchart of the AC calibration executed in the image forming device 1 according to the present embodiment. FIG. 5 is a flowchart of a first approximation expression determination step of the AC calibration executed in the image forming device 1 according to the present embodiment. FIG. 6 is a flowchart of a second approximation expression determination step of the AC calibration executed in the image forming device 1 according to the present embodiment.

In the present embodiment, the calibration execution portion 984 executes the AC calibration (bias condition determination mode) at the timing when the image forming operation is not executed. The AC calibration is a mode for determining the reference peak-to-peak voltage (target voltage) which is the reference of the peak-to-peak voltage (Vpp) of the AC voltage of the development bias applied to the development roller 231 in the image forming operation.

When the AC calibration is started, the calibration execution portion 984 sequentially executes the first approximation expression determination step (step S01 in FIG. 4), the second approximation expression determination step (step S02 in FIG. 4), and a target voltage determination step (step 03 in FIG. 4).

The first approximation expression determination step will be described in detail with reference to FIG. 5. When the first approximation expression determination step is started, the calibration execution portion 984 acquires the information on the first measurement range stored in the storage portion 983. The first measurement range is information on the range and interval of the Vpp of the AC bias applied to the development roller 231 in the first approximation expression determination step. In the present embodiment, as an example, information on the four first measurement peak-to-peak voltages is acquired by the calibration execution portion 984. As a result, the first measurement range in the first approximation expression determination step is determined (step S11).

Next, the calibration execution portion 984 forms a measurement latent image on the photoconductor drum 20, and develops the measurement latent image by applying a development bias to the development roller 231. Specifically, as in the case at the time of image formation, the photoconductor drum 20 is rotated, and by the charge device 21, the peripheral surface of the photoconductor drum 20 is uniformly charged to 250 V. As an example, the charge range of the photoconductor drum 20 in the axial direction (width direction) is set to 322 mm. Then, the potential of a part of the photoconductor drum 20 is lowered to 10 V by the exposure light irradiated from the exposure device 22, and the measurement latent image is formed on the photoconductor drum 20. In the present embodiment, the width of the measurement latent image is set to 287 mm and the width of the magnetic brush of the development roller is set to 304 mm with respect to the sheet width of 297 mm (A4 width), and the difference between the width of the magnetic brush and the width of the measurement latent image is the area where the non-image magnetic brush current flows.

On the other hand, the development roller 231 has an AC bias, which has a frequency of 10 kHz and a duty of 50%, superimposed on a DC voltage of 150 V. The Vpp of the AC bias is sequentially set to the above four first measurement peak-to-peak voltages. As a result, with respect to each first measurement peak-to-peak voltage, when the above measurement latent image is developed by the development roller 231, the ammeter 973 respectively measures the DC component (DC current Idc) of the development current flowing across the development roller 231 and the development bias application portion 971 (step S12). As a result, four development currents corresponding to the four first measurement peak-to-peak voltages are acquired, and four sets of data on the first measurement peak-to-peak voltage and the development current are acquired. Further, it is desirable that the development current is calculated with an average current of one lap or more for the rotation of the development roller 231, and it is more desirable to make an average for the rotation of an integral multiple of one lap.

Next, the calibration execution portion 984, with a primary expression, returns the relation between the above four first measurement peak-to-peak voltages and the four development currents, and calculates a correlation coefficient R thereof (step S13). As an example, the calibration execution portion 984 calculates the primary expression by the least-square method, and acquires the correlation coefficient R.

Next, the calibration execution portion 984 compares the magnitude relation between the correlation coefficient R acquired above and a threshold R1 stored in the storage portion 983 in advance (step S14). As an example, the threshold R1 is set to 0.90. Here, when the threshold R1≤correlation coefficient R (YES in step S14), the calibration execution portion 984 determines the primary expression returned above as the first approximation expression (step S15). On the other hand, when the threshold R1>correlation coefficient R in step S14 (NO in step S14), the calibration execution portion 984 removes the maximum Vpp data among the above four sets of data and recalculates the correlation coefficient R based on the remaining 3 data. After that, the calibration execution portion 984 executes steps S14 and S15 in the same manner as above. Further, when the relation of threshold R1≤correlation coefficient R is not satisfied even after removing the data of the maximum Vpp in step S16, the calibration execution portion 984 may further remove some data and repeat the step, or may interrupt the execution of the AC calibration and use the result of the previous AC calibration by reference.

As described above, when the first approximation expression determination step is completed, the second approximation expression determination step is started. The second approximation expression determination step is to be described in detail with reference to FIG. 6. When the second approximation expression determination step is started, the calibration execution portion 984 acquires the information on the second measurement range stored in the storage portion 983. The second measurement range is information on the range and interval of the Vpp of the AC bias applied to the development roller 231 in the second approximation expression determination step. In the present embodiment, as an example, information on the three second measurement peak-to-peak voltages is acquired by the calibration execution portion 984. As a result, the second measurement range in the second approximation expression determination step is determined (step S21). Further, the minimum value of the second measurement range (three second measurement peak-to-peak voltages) is set larger than the maximum value of the first measurement range (four first measurement peak-to-peak voltages).

Next, in the same manner as step S12 in FIG. 5, the calibration execution portion 984 forms the measurement latent image on the photoconductor drum 20, and applies the development bias to the development roller 231, to thereby develop the above measurement latent image. At this time, the development roller 231 has an AC bias, which has a frequency of 10 kHz and a duty of 50%, superimposed on a DC voltage of 150 V, and the Vpp of the AC bias is sequentially set to the above three second measurement peak-to-peak voltages. As a result, with respect to each second measurement peak-to-peak voltage, when the above measurement latent image is developed by the development roller 231, the ammeter 973 respectively measures the DC component (DC current Idc) of the development current flowing across the development roller 231 and the development bias application portion 971 (step S22). As a result, three development currents corresponding to the three second measurement peak-to-peak voltages are acquired, and three sets of data on the second measurement peak-to-peak voltage and the development current are acquired.

Next, the calibration execution portion 984, with the primary expression (first determination approximation expression), returns the relation between the above three second measurement peak-to-peak voltages and the three development currents, and calculates a slope L thereof (step S23). As an example, the calibration execution portion 984 calculates the primary expression by the least-square method, and acquires the slope L.

Next, the calibration execution portion 984 compares the magnitude relation between the slope L acquired above and the threshold L1 stored in the storage portion 983 in advance (step S24). As an example, the threshold L1 is set to 0 (zero). Here, when the slope L<the threshold L1 (YES in step S24), the calibration execution portion 984 determines the primary expression returned above as the second approximation expression (step S25). On the other hand, when the slope L≥the threshold L1 in step S24 (NO in step S24), the calibration execution portion 984 calculates the average value of the Vpp of the above three sets of data, and sets, as the second approximation expression, a linear expression in which the average value becomes constant with respect to the change of the peak-to-peak voltage (step S26).

When the first approximation expression determination step and the second approximation expression determination step shown in FIGS. 5 and 6 are respectively completed, the calibration execution portion 984 executes the target voltage determination step (step S03 in FIG. 4). In the target voltage determination step, the calibration execution portion 984 determines, as the reference peak-to-peak voltage (target voltage VT), the peak-to-peak voltage at an intersection where the first approximation expression and the second approximation expression intersect each other. As a result, the peak-to-peak voltage at the time of the image forming operation can be set near a boundary (near the peak) of the relation between the peak-to-peak voltage and the development current in each of the first measurement range and the second measurement range. In the present embodiment, the reference peak-to-peak voltage acquired by multiplying the above determined reference peak-to-peak voltage by 1.2, including a specific safety factor, is applied as an actual peak-to-peak voltage at the time of the image forming operation.

Hereinafter, the AC calibration in the present embodiment will be described in more detail based on the data. The data described below was executed based on the following conditions.

<Common Conditions>

Print speed: 55 sheets/minute

Photoconductor drum 20: Amorphous silicon photoconductor (α-Si)

Development roller 231: Outer diameter 20 mm, surface shape knurled groove machining and blasting (80 rows of recesses (grooves) are formed along the circumferential direction), Regulation blade 234: Made of SUS430, magnetic, thickness 1.5 mm Development agent transfer volume after regulation blade 234: 250 g/m$^2$ Peripheral speed of development roller 231 with respect to photoconductor drum 20: 1.8 (trailing direction in the opposite position)

Distance between photoconductor drum 20 and development roller 231: 0.25 mm White background portion (background portion) potential VO of photoconductor drum 20: +250 V Image portion potential VL of photoconductor drum 20: +10 V Development bias of development roller 231: AC voltage square wave (Vpp is adjusted according to each experimental condition) with frequency=7 kHz and duty=50%, Vdc (DC voltage)=150 V Toner: Positively charged polar toner, volume average particle diameter 6.8 μm, toner concentration 6%

Carrier: Volume average particle diameter 35 μm, Ferrite/Resin coat carrier

<Development Agent>

The same effect has been confirmed regardless of whether the toner is a crushed toner or a toner with a core shell structure. Further, for the toner concentration as well, it has been confirmed that the same effect was achieved in the range of 3% to 12%. The finer the magnetic brush, the more prominent the transfer of the toner due to the AC electric field. Therefore, the volume average particle size of the carrier is preferably 45 μm or less, and more preferably 30 μm or more and 40 μm or less. In addition, a resin carrier smaller in true specific gravity than a ferrite carrier is more preferable.

<Carrier>

The carrier is a ferrite core with a volume average particle diameter of 35 μm coated with silicone, fluorine, etc. Specifically, the carrier has been created by the following procedure. On 1000 parts by weight of Carrier Core EF-35 (manufactured by Powdertech Co., Ltd.), a coating liquid is prepared by dissolving 20 parts by mass of silicone resin KR-271 (manufactured by Shin-Etsu Chemical Co., Ltd.) in 200 parts by mass of toluene. Then, after spray-coating the coating liquid with a fluidized bed coating device, heat treatment was executed at 200° C. for 60 minutes, to thereby acquire a carrier. In this coating liquid, a conductive agent and a charge control agent are each mixed with 100 parts of the coat resin in the range of 0 to 20 parts and dispersed, to thereby adjust the resistance and the charge.

Figure 7:
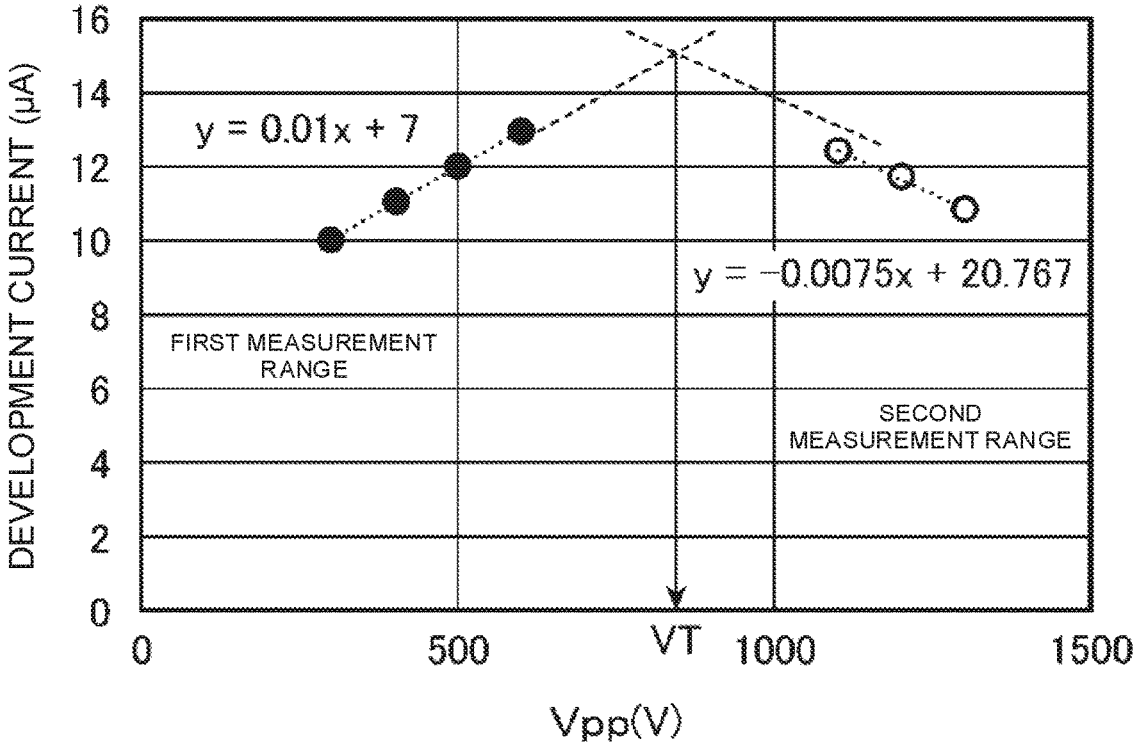
FIG. 7 is a graph showing a relation between a Vpp and the development current of the AC calibration executed in the image forming device, according to the one embodiment of the present disclosure.
Figure 8:
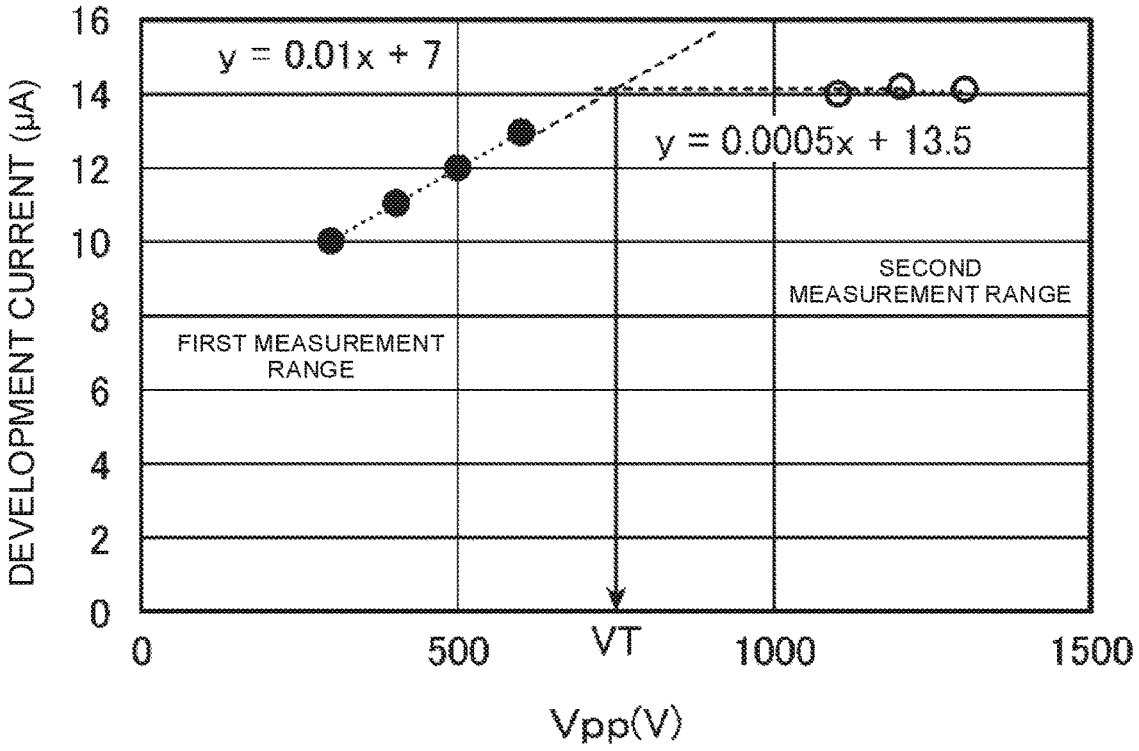
FIG. 8 is a graph showing the relation between the Vpp and the development current of the AC calibration executed in the image forming device, according to the one embodiment of the present disclosure.
Figure 9:
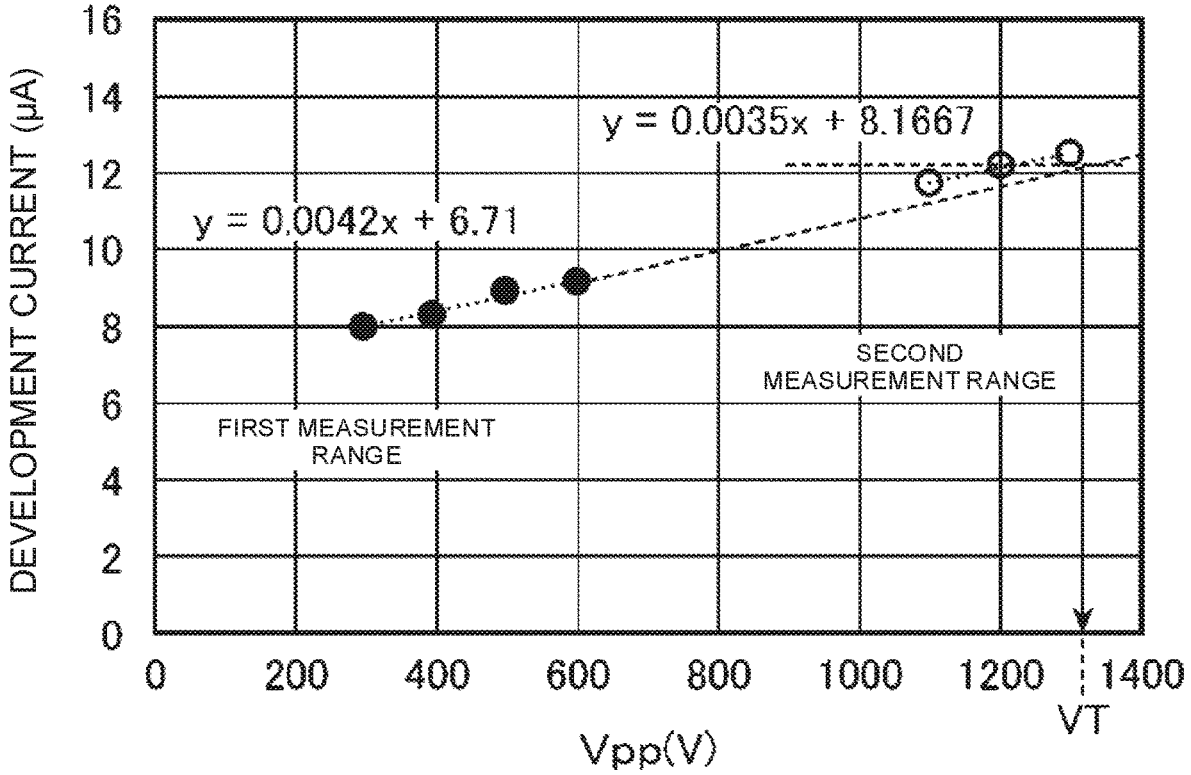
FIG. 9 is a graph showing the relation between the Vpp and the development current of the AC calibration executed in the image forming device, according to the one embodiment of the present disclosure.

FIGS. 7, 8 and 9 are graphs respectively showing the relation between the Vpp and the development current of the AC calibration executed in the image forming device 1 according to the present embodiment. In each figure, the development current is shown on the vertical axis (Y axis) and the Vpp is shown on the horizontal axis (X axis).

Tables 1 and 2 show the relation between the Vpp and the development current in the first measurement range and the second measurement range shown in FIG. 7.

TABLE 1

| FIRST MEASUREMENT RANGE | |
|---|---|
| MEASUREMENT VOLTAGE Vpp (V) | DEVELOPMENT CURRENT (μA) |
| 300 | 10 |
| 400 | 11 |
| 500 | 12 |
| 600 | 13 |

TABLE 2

| SECOND MEASUREMENT RANGE | |
|---|---|
| MEASUREMENT VOLTAGE Vpp (V) | DEVELOPMENT CURRENT (μA) |
| 1100 | 14 |
| 1200 | 14.2 |
| 1300 | 14.1 |

In FIG. 7, in the first approximation expression determination step shown in FIG. 5, the primary expression of y=0.01x+7 is calculated as the first approximation expression. On the other hand, in the second approximation expression determination step shown in FIG. 6, since the slope L is minus (L<L1=0), the primary expression of y=−0.0075x+20.767 is calculated as the second approximation expression in step S25. As a result, in the target voltage determination step S03, Vpp=target voltage VT=787 V is calculated as the intersection of the first approximation expression and the second approximation expression, and 1.2 is set as the safety factor, and thereby, Vpp=787×1.2=944 (V) at the time of the image forming operation is selected.

Tables 3 and 4 show the relation between the Vpp and the development current in the first measurement range and the second measurement range shown in FIG. 8.

TABLE 3

| FIRST MEASUREMENT RANGE | |
|---|---|
| MEASUREMENT VOLTAGE Vpp (V) | DEVELOPMENT CURRENT (μA) |
| 300 | 10 |
| 400 | 11 |
| 500 | 12 |
| 600 | 13 |

TABLE 4

| SECOND MEASUREMENT RANGE | |
|---|---|
| MEASUREMENT VOLTAGE Vpp (V) | DEVELOPMENT CURRENT (μA) |
| 1100 | 12.5 |
| 1200 | 11.8 |
| 1300 | 11 |

In FIG. 8, in the first approximation expression determination step shown in FIG. 5, the primary expression of y=0.01x+7 is calculated as the first approximation expression. On the other hand, in the second approximation expression determination step shown in FIG. 6, since the slope L is plus (L>L1=0), the average value of the development current is calculated in step S026, and the primary expression of y=14.1 as the second approximation expression is calculated. As a result, in the target voltage determination step S03, Vpp=target voltage VT=710 V is calculated as the intersection of the first approximation expression and the second approximation expression, and 1.2 is set as the safety factor, and thereby, Vpp=710×1.2=852 (V) at the time of the image forming operation is selected.

Tables 5 and 6 show the relation between the Vpp and the development current in the first measurement range and the second measurement range shown in FIG. 9.

TABLE 5

| FIRST MEASUREMENT RANGE | |
|---|---|
| MEASUREMENT VOLTAGE Vpp (V) | DEVELOPMENT CURRENT (μA) |
| 300 | 8 |
| 400 | 8.3 |
| 500 | 8.9 |
| 600 | 9.2 |

TABLE 6

| SECOND MEASUREMENT RANGE | |
|---|---|
| MEASUREMENT VOLTAGE Vpp (V) | DEVELOPMENT CURRENT (μA) |
| 1100 | 12 |
| 1200 | 12.4 |
| 1300 | 12.7 |

In FIG. 9, in the first approximation expression determination step shown in FIG. 5, the primary expression of y=0.0042x+6.71 is calculated as the first approximation expression. On the other hand, in the second approximation expression determination step shown in FIG. 6, since the slope L is plus (L>L1=0), the average value of the development current is calculated in step S026, and the primary expression of y=12.4 is calculated as the second approximation expression. As a result, in the target voltage determination step S03, Vpp=target voltage VT=1310 V is calculated as the intersection of the first approximation expression and the second approximation expression, and 1.2 is set as the safety factor, and thereby, Vpp=1310×1.2=1572 (V) at the time of the image forming operation is selected.

<Reason why Development Current (DC Component) has a Peak (Change Point)>

Next, we infer the reason why the development current (DC component) has a peak (change point) with respect to the Vpp as in each of the above data. As described above, the development current is composed of "toner transfer current+image portion magnetic brush current+non-image portion magnetic brush current", but when the development current is to be acquired, in the part (solid image portion) corresponding to the image portion of the electrostatic latent image, both of these "toner transfer current+image portion magnetic brush current" flow, but in the white background portion at the end portion in the width direction, only the "non-image portion magnetic brush current" flows in the direction opposite to that of the image portion. Therefore, as the Vpp is increased, the non-image portion magnetic brush current of this white background portion increases, and the development current in total decreases.

Further, the image portion magnetic brush current of the image portion also increases as the Vpp increases, but the toner layer formed by the toner adhering to the surface of the photoconductor drum 20 becomes a resistance layer, and an extreme increase of the image portion magnetic brush current is suppressed. On the other hand, in the white background portion, some toner moves to the sleeve surface of the development roller 231, but the amount thereof is overwhelmingly smaller compared with the image portion, so the toner layer which adhered to the sleeve surface does not become higher in resistance compared with the image portion. As a result, the non-image portion magnetic brush current of the white background portion significantly increases together with the increase in Vpp, and this magnetic brush current flows in the direction opposite to that of the toner transfer current. Therefore, it is presumed that the development current will have the change point (peak).

Through repeated diligent experiments, the present inventor has newly discovered the above relation between the development current and the Vpp. In addition, it has been further found that this phenomenon is more likely to occur as the resistance of the carrier is lower, and in the case where the resistance of the carrier is sought based on the current that flows when 0.2 g of carrier is filled between parallel flat plates (area 240 $mm^2$) with a gap of 1 mm and a voltage of 1000 V is applied, this phenomenon prominently appears at $10^9$ (10 to the 9th power) ohms or below.

That is, when the two-component development agent is interposed between the photoconductor drum 20 and the development roller 231, the measurement latent image is formed in the center portion in the axial direction (width direction) of the electrostatic latent image, and the white background portions are arranged at both end portions thereof, the above change point occurs to the boundary between two ranges including the first measurement range and the second measurement range in the present embodiment. In particular, the phenomenon that the slope of the second approximation expression is distributed over a wide range of positive and negative is due to the fact that, in both end portions in the axial direction of the development roller 231 as described above, the current flows in the direction opposite to that of the central portion. In particular, in the present embodiment, it is so set that, in the axial direction, the magnetic brush range on the development roller 231 is narrower than the charge range on the photoconductor drum 20, and of the measurement latent image formed on the photoconductor drum 20, the range of the image portion (solid image portion) is further narrower than the magnetic brush range. As a result, as described above, in both end portions in the axial direction of the development roller 231, the area in which the current in the direction opposite to that of the image portion flows through the magnetic brush is formed. And, such a phenomenon is a phenomenon peculiar to the development nip portion, which phenomenon cannot occur to the discharge current generated between the photoconductor drum 20 and the charge roller in contact with the peripheral surface of the photoconductor drum 20, and was discovered by repeated experiments as described above. In particular, no development agent, which may cause fluctuations due to the resistance of the carrier, is intervening between the charge roller and the photoconductor drum 20, therefore, it is unlikely that the current will eventually decrease as the peak-to-peak voltage is increased.

As described above, in the present embodiment, the reference peak-to-peak voltage is set from the intersection of the first approximation expression and the second approximation expression which represent the relation between the peak-to-peak voltage of the AC bias and the development current in each of the first measurement range and the second measurement range. In the vicinity of the above intersection, there exists the change point of the relation between the peak-to-peak voltage of the AC bias and the development current, so the vicinity is not easily affected by the slope of the first approximation expression in the first measurement range, and it is possible to prevent the image concentration from changing due to fluctuations of the toner charge amount and development gap. In addition, it is suppressed to set the reference peak-to-peak voltage in the area where the slope of the second approximation expression becomes smaller than the specific threshold according to the fluctuation of the carrier resistance and the like and the development current tends to decrease as the peak-to-peak voltage increases. As a result, it is possible to set the AC bias of the development bias that can output a stable image concentration in the image forming operation. Further, with respect to the reference peak-to-peak voltage, a value of the reference peak-to-peak voltage as it is, a value acquired by multiplying the reference peak-to-peak voltage by a certain ratio or a value acquired by adding a constant value to the reference peak-to-peak voltage, or a value acquired by multiplying the certain ratio and adding the certain value may be used for the actual peak-to-peak voltage at the time of the image forming operation.

Further, in the present embodiment, by the least-square method, the calibration execution portion 984 determines the first approximation expression from the DC component of the development current respectively acquired at at least three first measurement peak-to-peak voltages included in the first measurement range. According to this configuration, by a simple arithmetic processing, the first approximation expression can be determined from the first measurement peak-to-peak voltage included in the first measurement range.

Further, in the present embodiment, when the slope of the first determination approximation expression, which is the primary approximation expression determined by the least-square method from the DC component of the development current respectively acquired in at least three second measurement peak-to-peak voltages included in the second measurement range, is larger than the preset first threshold L1, the calibration execution portion 984 sets, as the second approximation expression, a linear expression in which the average value of the DC components of the development currents respectively acquired in the at least three second measurement peak-to-peak voltages, becomes constant with respect to a change in the peak-to peak voltage. When the slope of the first determination approximation expression is smaller than the first threshold L1, the calibration execution portion 984 sets the first determination approximation expression as the second approximation expression. According to this configuration, in the process of determining the second approximation expression whose slope is likely to change due to the influence of the resistance value or the like of the carrier, a more appropriate approximation expression can be selected as the second approximation expression according to the slope of the first determination approximation expression.

Further, in the present embodiment, the interval between the plurality of first measurement peak-to-peak voltages in the first measurement range and the interval between the plurality of second measurement peak-to-peak voltages in the second measurement range are respectively set smaller than the interval between the maximum value of the first measurement range and the minimum value of the second measurement range. According to this configuration, the first measurement range and the second measurement range can be clearly distinguished, and the interval between peak voltages is finely set in each measurement range, thereby the decision accuracy of the first approximation expression and the second approximation expression can be improved.

In addition, in the first approximation expression determination operation, when the correlation coefficient of the first approximation expression is smaller than the preset second threshold, the calibration execution portion 984 determines the first approximation expression based on the DC component of the development current with respect to the remaining peak-to-peak voltage acquired by excluding at least one peak-to-peak voltage from the at least three first measurement peak-to-peak voltages. According to this configuration, when the correlation coefficient is small in the process of determining the first approximation expression, it is possible to determine the first approximation expression with higher accuracy by excluding the data of at least one peak-to-peak voltage.

In particular, in the first approximation expression determination operation, when the correlation coefficient of the first approximation expression is smaller than the preset second threshold R1, the calibration execution portion 984 determines the first approximation expression based on the DC component of the development current with respect to the remaining peak-to-peak voltage acquired by excluding the largest peak-to-peak voltage among the at least three first measurement peak-to-peak voltages. According to this configuration, when the correlation coefficient is small in the process of determining the first approximation expression, the first approximation expression with higher accuracy can be determined by excluding the data of the peak-to-peak voltage close to the second measurement range.

Further, from the second measurement range, the calibration execution portion 984 excludes in advance the maximum peak-to-peak voltage or the minimum peak-to-peak voltage excluded in the second approximation expression determination operation, and the calibration execution portion 984 executes the next bias condition determination mode. According to this configuration, the data excluded in the previous bias condition determination mode is excluded from the beginning in the next bias condition determination mode, so that the mode execution time can be shortened and the highly accurate reference peak-to-peak voltage can be determined.

Further, in the present embodiment, the number of the at least three first measurement peak-to-peak voltages in the first measurement range is set larger than the number of the at least three second measurement peak-to-peak voltages in the second measurement range. According to this configuration, the slope of the first approximation expression is positive, and by acquiring a relatively large amount of data in the first measurement range where the development current is likely to significantly change, a more accurate reference peak-to-peak voltage can be determined.

Further, in the present embodiment, the change point at which the balance (total of each current) of the toner transfer current, the image portion magnetic brush current, and the non-image portion magnetic brush current changes can be predicted by the intersection of the two approximation expressions, and the reference peak-to-peak voltage can be determined.

Further, in the present embodiment, the setting of the reference peak-to-peak voltage is determined based on the development current. Conventionally, it was considered to measure the image concentration and determine the reference peak-to-peak voltage from stability of the image concentration, but for example, a concentration sensor that measures the image concentration on the photoconductor drum 20 and the intermediate transfer belt 141 had a tendency to show a decreased measurement accuracy when the image concentration becomes high, thus failing to accurately detect the image concentration in the second measurement range of the present disclosure. From this point as well, it is preferable that the data for determining the reference peak-to-peak voltage in the first measurement range and the second measurement range is the development current.

In addition, since the development current is likely to significantly change in the first measurement range, it is desirable to execute measurement in the widest possible range of the peak-to-peak voltage. On the other hand, in the second measurement range, the change in the development current is relatively small, and when the peak-to-peak voltage is set excessively large, a leak may occur to the development nip portion. Therefore, it is desirable to set the second measurement range narrower than the first measurement range, and set a small number of measurement points. As a result, it is possible to shorten the mode execution time and suppress the amount of the toner consumed.

Further, the development current may be measured in the circuit in the development bias application portion 971. The transfer current of the toner can be measured also on the photoconductor drum 20 side, but since the photoconductor drum 20 also includes the current flowing from the transfer roller, these currents cannot be separated. Therefore, it is desirable to measure the development current on the development bias application portion 971 side.

Although the embodiment of the present disclosure has been described above, the present disclosure is not limited to this, and for example, the following modified embodiments can be adopted.

(1) In the above embodiment, the knurled groove machining and blasting is applied to the surface of the development roller 231. However, the surface of the development roller 231 may be one that has a concave shape (dimple) and blasting, or the other that has only blasting, only the knurled groove, only the concave shape (dimple), or plating executed.

(2) When the image forming device 10 has a plurality of development devices 23 as shown in FIG. 1, the AC calibration according to the above embodiment may be executed by one or two development devices 23, and the result thereof may be used for another development device 23.

Figure 10:
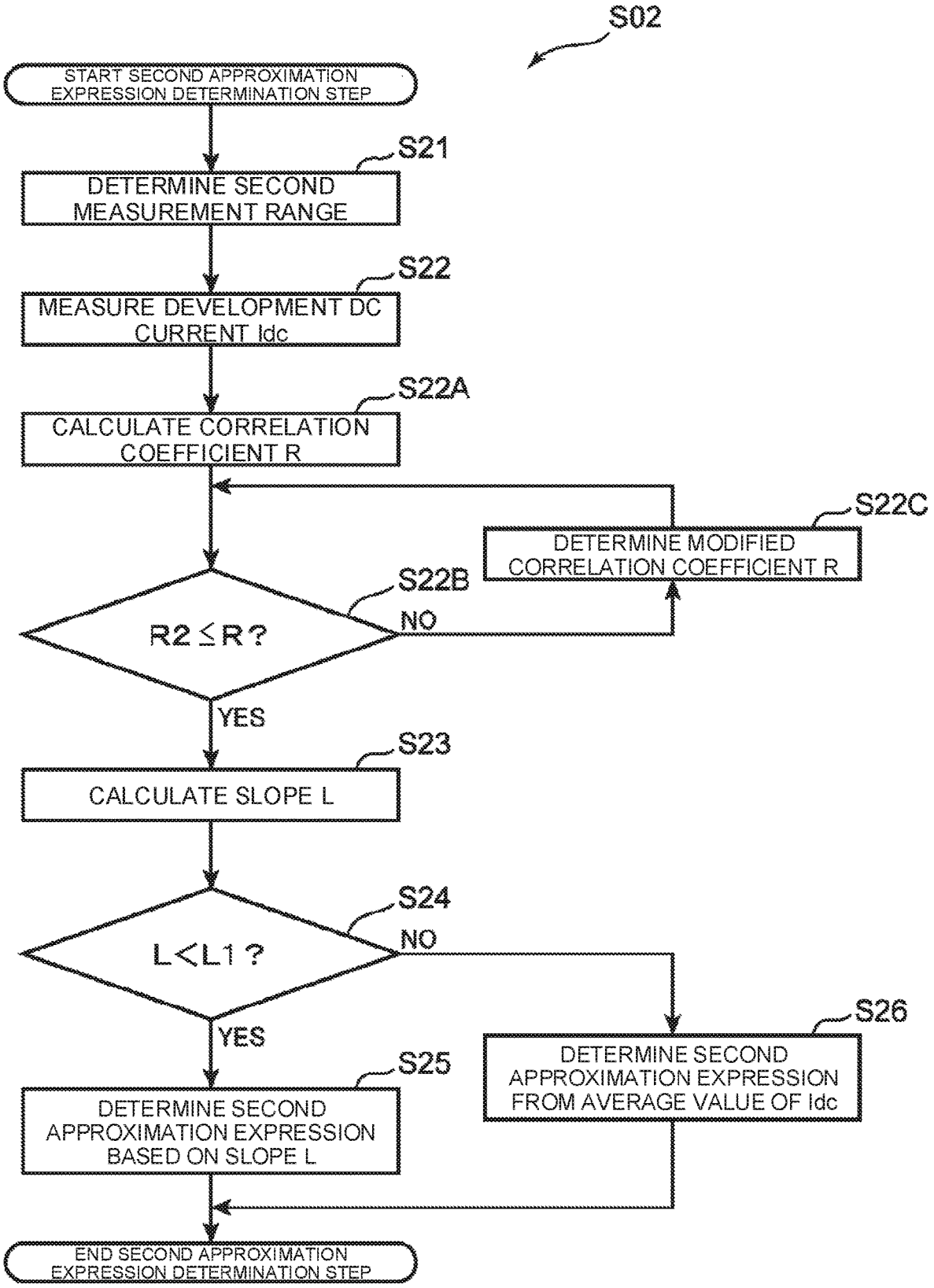
FIG. 10 is a flowchart of the second approximation expression determination step of the AC calibration executed in the image forming device, according to a modified embodiment of the present disclosure.
Figure 11:
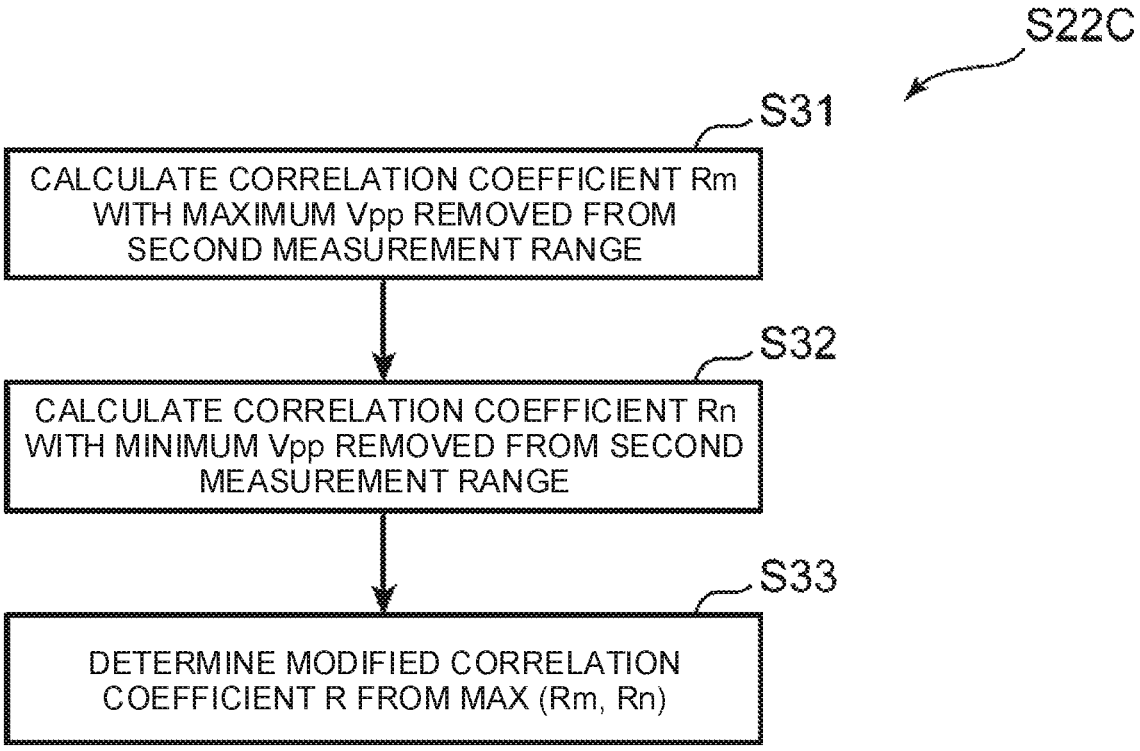
FIG. 11 is a partial flowchart of the second approximation expression determination step of the AC calibration executed in the image forming device, according to the modified embodiment of the present disclosure.

(3) FIG. 10 is a flowchart of the second approximation expression determination step of the AC calibration executed in the image forming device according to the modified embodiment of the present disclosure. FIG. 11 shows a partial flowchart of the second approximation expression determination step. Compared with the previous embodiment, the present modified embodiment is different in steps S22A, S22B, and S22C in FIG. 10. That is, the DC component (DC current Idc) of the development current is measured in step S22. At this time, in the present modified embodiment, as in the first approximation expression determination step, the DC components of the four development currents corresponding to the four second measurement peak-to-peak voltages are acquired, and four sets of data on the second measurement peak-to-peak voltages and the DC components of the development currents are acquired.

Here, the calibration execution portion 984 calculates the correlation coefficient R in the same manner as in the first approximation expression determination step (step S22A). Then, the magnitude relation between the correlation coefficient R, and a threshold R2 which is stored in the storage portion 983 in advance, is compared (step S22B). As an example, the threshold R2 is set to 0.90. Here, when the threshold R2≤the correlation coefficient R (YES in step S22B), as in the previous embodiment, the calibration execution portion 984 calculates the slope L in step S23 and then, based on the determination result in step S24, respectively calculates the second approximation expression in step S25 or step S26. On the other hand, in step S22B, when R2>R (NO in step S22B), the calibration execution portion 984 determines the modified correlation coefficient R of step S22C.

With reference to FIG. 11, when the determination step of the modified correlation coefficient R is started, in step S31, in a state where the maximum Vpp data among the above four sets of data is removed, the calibration execution portion 984 calculates a correlation coefficient Rm, based on the remaining three data in (step S31). Next, in a state where the minimum Vpp data among the above four sets of data is removed, the calibration execution portion 984 calculates a correlation coefficient Rn, based on the remaining three data (step S32). Then, the calibration execution portion 984 compares the magnitude relation of the correlation coefficients Rm and Rn calculated above, and selects the larger correlation coefficient as the modified correlation coefficient R (step S33). After that, returning to FIG. 10, the processings after step S22B are repeated based on the selected modified correlation coefficient R.

As described above, in the present modification embodiment, when the correlation coefficient is small in the second approximation expression determination step, the data having a high correlation coefficient is selected, and the second approximation expression is set based on the data. Therefore, by excluding the data of at least one peak-to-peak voltage, a more accurate second approximation expression can be determined.

In particular, the calibration execution portion 984 compares the correlation coefficient Rm of the second determination approximation expression determined based on the DC component of the development current with respect to the remaining peak-to-peak voltages acquired by excluding the maximum peak-to-peak voltage among the at least three second measurement peak-to-peak voltages, with the correlation coefficient Rn of a third determination approximation expression determined based on the DC component of the development current with respect to the remaining peak-to-peak voltages acquired by excluding the minimum peak-to-peak voltage of the at least three second measurement peak-to-peak voltages, and determines, as the second approximation expression, the determination approximation expression having the larger correlation coefficient among the second determination approximation expression and the third determination approximation expression. According to this configuration, when the correlation coefficient is small in the process of determining the second approximation expression, the data of the minimum peak-to-peak voltage closest to the first measurement range in the second measurement range or the data of the maximum peak-to-peak voltage that is likely to cause a discharge leak and likely to include a noise is excluded, to thereby make it possible to determine a more accurate second approximation expression.

What is claimed is:

1. An image forming device capable of executing an image forming operation that forms an image on a sheet, the image forming device comprising:

an image carrier that is rotated, and has a surface that allows an electrostatic latent image to be formed and carries a toner image which is the electrostatic latent image manifested by a toner;

a charge device that charges the image carrier to a specific charge potential;

an exposure device that is arranged on a more downstream side than the charge device in a rotational direction of the image carrier, and that exposes, according to specific image information, the surface of the image carrier charged to the charge potential to thereby form the electrostatic latent image;

a development device that is arranged to face the image carrier in a specific development nip portion on a more downstream side than the exposure device in the rotational direction, and includes a development roller that has a peripheral surface, which is rotated and carries a development agent composed of the toner and a carrier, and that forms the toner image by supplying the toner to the image carrier;

a transfer portion that transfers, to the sheet, the toner image supported on the image carrier;

a development bias application portion capable of applying, to the development roller, a development bias in which an AC voltage is superimposed on a DC voltage;

a current detection portion capable of detecting a DC component of a development current that flows across the development roller and the development bias application portion; and a bias condition determination portion that, based on the DC component of the development current detected by the current detection portion when a specific measurement latent image is developed with the toner by applying the development bias to the development roller corresponding to the specific measurement latent image formed on the image carrier, executes a bias condition determination mode that determines a reference peak-to-peak voltage which becomes a reference for a peak-to-peak voltage of the AC voltage of the development bias applied to the development roller in the image forming operation, wherein in the bias condition determination mode, the bias condition determination portion executes each of:

a first approximation expression determination operation that respectively acquires the DC component of the development current under a condition that the peak-to-peak voltages of the AC component of the development bias are respectively set to at least three first measurement peak-to-peak voltages included in a specific first measurement range, and determines a first approximation expression which is a primary approximation expression showing a relation between the first measurement peak-to-peak voltage in the first measurement range and the DC component of the acquired development current, a second approximation expression determination operation that respectively acquires the DC component of the development current under a condition that the peak-to-peak voltages of the AC component of the development bias are respectively set to at least three second measurement peak-to-peak voltages included in a second measurement range set to have a minimum value larger than a maximum value of the first measurement range, and determines a second approximation expression which is a primary approximation expression showing a relation between the second measurement peak-to-peak voltage in the second measurement range and the DC component of the acquired development current, and a reference voltage determination operation that determines, as the reference peak-to-peak voltage, the peak-to-peak voltage at an intersection where the first approximation expression determined by the first approximation expression determination operation and the second approximation expression determined by the second approximation expression determination operation intersect each other.

2. The image forming device according to claim 1, wherein by a least-square method, the bias condition determination portion determines the first approximation expression from the DC component of the development current respectively acquired at the at least three first measurement peak-to-peak voltages included in the first measurement range.

3. The image forming device according to claim 1, wherein when a slope of the first determination approximation expression, which is a primary approximation expression determined by a least-square method from the DC component of the development current respectively acquired in the at least three second measurement peak-to-peak voltages included in the second measurement range, is larger than a preset first threshold, the bias condition determination portion sets, as the second approximation expression, a linear expression in which an average value of the DC components of the development currents respectively acquired in the at least three second measurement peak-to-peak voltages becomes constant with respect to a change in the peak-to-peak voltage, and when the slope of the first determination approximation expression is smaller than the first threshold, the bias condition determination portion sets the first determination approximation expression as the second approximation expression.

4. The image forming device according to claim 1, wherein an interval between the plurality of first measurement peak-to-peak voltages in the first measurement range and an interval between the plurality of second measurement peak-to-peak voltages in the second measurement range are respectively set smaller than an interval between the maximum value of the first measurement range and the minimum value of the second measurement range.

5. The image forming device according to claim 1, wherein in the first approximation expression determination operation, when a correlation coefficient of the first approximation expression is smaller than a preset second threshold, the bias condition determination portion determines the first approximation expression based on the DC component of the development current with respect to the remaining peak-to-peak voltage acquired by excluding at least one peak-to-peak voltage from the at least three first measurement peak-to-peak voltages.

6. The image forming device according to claim 5, wherein in the first approximation expression determination operation, when the correlation coefficient of the first approximation expression is smaller than the second threshold, the bias condition determination portion determines the first approximation expression based on the DC component of the development current with respect to the remaining peak-to-peak voltage acquired by excluding the largest peak-to-peak voltage among the at least three first measurement peak-to-peak voltages.

7. The image forming device according to claim 1, wherein in the second approximation expression determination operation, when a correlation coefficient of the second approximation expression is smaller than a preset third threshold, the bias condition determination portion determines the second approximation expression based on the DC component of the development current corresponding to the remaining peak-to-peak voltage acquired by excluding the at least one peak-to-peak voltage from the at least three second measurement peak-to-peak voltages.

8. The image forming device according to claim 7, wherein in the second approximation expression determination operation, when the correlation coefficient of the second approximation expression is smaller than the third threshold, the bias condition determination portion compares a correlation coefficient of the second determination approximation expression determined based on the DC component of the development current with respect to the remaining peak-to-peak voltages acquired by excluding the maximum peak-to-peak voltage among the at least three second measurement peak-to-peak voltages, with a correlation coefficient of a third determination approximation expression determined based on the DC component of the development current with respect to the remaining peak-to-peak voltages acquired by excluding the minimum peak-to-peak voltage of the at least three second measurement peak-to-peak voltages, and determines, as the second approximation expression, the determination approximation expression having the larger correlation coefficient among the second determination approximation expression and the third determination approximation expression.

9. The image forming device according to claim 7, wherein, from the second measurement range, the bias condition determination portion excludes in advance the maximum peak-to-peak voltage or the minimum peak-to-peak voltage excluded in the second approximation expression determination operation, and the bias condition determination portion executes a next bias condition determination mode.

10. The image forming device according to claim 1, wherein the number of the at least three first measurement peak-to-peak voltages in the first measurement range is set larger than the number of the at least three second measurement peak-to-peak voltages in the second measurement range.

11. The image forming device according to claim 1, wherein the bias condition determination portion acquires, by the intersection of the first approximation expression and the second approximation expression, a change point which is a point at which a balance among three currents that constitute the DC component of the development current and include a toner transfer current caused by the toner transferring from the development roller to the image carrier in an image forming portion of the development nip portion, an image portion magnetic brush current which is a current that flows in a direction same as a direction of the toner transfer current along a magnetic brush formed, by the toner and the carrier, in a manner to straddle the development roller and the image carrier, and a non-image portion magnetic brush current which is a current that flows in a direction opposite to the direction of the toner transfer current along the magnetic brush formed, by the toner and the carrier, in a manner to straddle the development roller and the image carrier in a non-image forming portion of the development nip portion changes according to a change in the peak-to-peak voltage, and determines, as the reference peak-to-peak voltage, the peak-to-peak voltage that corresponds to the change point.

* * * * *